US009200467B2

(12) United States Patent
Williams

(10) Patent No.: US 9,200,467 B2
(45) Date of Patent: Dec. 1, 2015

(54) STACKING BASE SYSTEM FOR TEMPORARY POSTS

(71) Applicant: Gordon Williams, Christopher Lake (CA)

(72) Inventor: Gordon Williams, Christopher Lake (CA)

( * ) Notice: Subject to any disclaimer, the term of this patent is extended or adjusted under 35 U.S.C. 154(b) by 328 days.

(21) Appl. No.: 13/731,820

(22) Filed: Dec. 31, 2012

(65) Prior Publication Data

US 2014/0182109 A1 Jul. 3, 2014

(51) Int. Cl.

| | |
|---|---|
| ***A47B 91/00*** | (2006.01) |
| ***E04H 12/22*** | (2006.01) |
| ***E01F 9/012*** | (2006.01) |

(52) U.S. Cl.

CPC ..... *E04H 12/2246* (2013.01); *E01F 9/0124* (2013.01); *E04H 12/2253* (2013.01); *Y10T 29/49826* (2015.01)

(58) Field of Classification Search

CPC . E01F 9/0124; B65D 19/002; B65D 2519/00; B65D 2519/00547; B65D 2519/00552; B65D 2519/00935; B65D 2519/00955; B65D 2519/0096; B65D 2519/00965; B65D 2519/0097; B65D 2519/00398; B65D 2519/00412; F16M 11/00; A63B 2071/026; E04H 12/2246; E04H 12/2238; E04H 12/22; E04H 12/2215

USPC ..... 248/346.2, 910, 678, 346.01, 346.02, 248/545, 530, 519, 357; 108/56.1, 54.1, 64, 108/57.29, 55.5; 206/597

See application file for complete search history.

(56) References Cited

U.S. PATENT DOCUMENTS

| | | | | |
|---|---|---|---|---|
| 4,486,016 | A * | 12/1984 | Rubin | 482/90 |
| 4,596,262 | A * | 6/1986 | Tegze | 135/21 |
| 5,094,023 | A | 3/1992 | McVey | |
| 5,497,972 | A * | 3/1996 | Sofy | 248/523 |
| 5,667,175 | A | 9/1997 | Brady | |
| 5,860,386 | A * | 1/1999 | Schwab et al. | 116/63 P |
| 5,897,018 | A * | 4/1999 | Pruitt | 220/603 |
| 6,560,906 | B1 | 5/2003 | Hillstrom | |
| 6,668,474 | B2 | 12/2003 | Winterton et al. | |
| 6,682,029 | B1 * | 1/2004 | Dierkes | 248/165 |
| 7,059,575 | B2 * | 6/2006 | Garton | 248/346.01 |
| 7,140,581 | B1 * | 11/2006 | White | 248/129 |
| 7,571,561 | B1 | 8/2009 | Garcia | |
| 7,584,563 | B2 * | 9/2009 | Hillstrom et al. | 40/607.01 |
| 7,883,070 | B2 * | 2/2011 | Schroeder et al. | 248/545 |
| 2004/0108435 | A1 * | 6/2004 | Reiter | 248/346.2 |
| 2006/0026877 | A1 * | 2/2006 | Dicke et al. | 40/607.1 |
| 2007/0200046 | A1 * | 8/2007 | Tota | 248/545 |
| 2007/0241255 | A1 * | 10/2007 | Dvoracek | 248/346.01 |

* cited by examiner

*Primary Examiner* — Anita M King

(74) *Attorney, Agent, or Firm* — Stites & Harbison, PLLC; David W. Nagle, Jr.

(57) ABSTRACT

A stacking base system for transporting to a work site supports a plurality of vertical posts. Each of a plurality of base members defines a fill port and includes a port plug adapted to be removably inserted in the fill port, and defines a post aperture, shaped to correspond to a cross-section of the posts, extending downward through the base member. Three legs extend down from outer edges each base member, and are equally spaced around the base member, and substantially equally spaced from the post aperture. The post aperture is oriented vertically when bottom ends of the legs are resting on a horizontal surface. The base members are stacked such that a top portion of a lower base member engages a bottom portion of a next adjacent upper base member and such that the plurality of base members forms a base stack.

9 Claims, 3 Drawing Sheets

STACKING BASE SYSTEM FOR TEMPORARY POSTS

This invention is in the field of temporary signage, barriers, and the like such as are used in construction areas and in particular a plurality of stackable bases for a vertical post, where the post must be moved from one temporary location to another temporary location to support a sign or barrier.

BACKGROUND

It is a common need in various industries, notably for example construction projects, to erect temporary signs controlling traffic and directing same to various locations. Similarly temporary barriers are often need for crowd control. Such signs and barriers are typically provided by a base that rests on the ground and may be anchored with stakes, and a vertical post extending up from the base, with the sign or barrier cross-member mounted to the post.

Often such temporary posts for signs and the like are provided, especially at construction sites where carpenters and materials are available, by nailing together a base and nailing the base to a post, and then attaching the sign to the post. It is often the case that the need for a sign arises during the construction process and so the available materials and personnel are used to supply the needs as they arise. Such construction takes up the valuable time of skilled workers, and so such signs can end up being quite costly. At construction sites as well, such vertical posts are often used as cord trees to support electrical wires, air hoses and the like above the ground to reduce the risk of injury to workers who could trip over same if they were lying on the ground.

The problem of providing a temporary portable sign has been addressed in the prior art. A temporary traffic sign is disclosed for example in U.S. Pat. No. 7,571,561 to Garcia where the lower part of a sign is pivotally attached to a base. U.S. Pat. No. 6,560,906 to Hillstrom shows a portable signpost assembly with a break-away post. U.S. Pat. No. 6,668,474 to Winterton et al. discloses an outdoor sign apparatus for mounting to a ground surface with two uprights, each mounted to a base and connected together for stability.

Such portable signs are exposed to wind and so require some anchoring or stabilizing to resist being knocked over by the wind. U.S. Pat. No. 5,094,023 to McVey and U.S. Pat. No. 5,667,175 to Brady disclose portable, temporary roadway sign stands that form a tripod for stability.

In many situations, such as construction projects, the quantity of signs, barriers, cord trees and the like is not known, and so it would be a benefit to have a quantity of temporary posts available to meet the needs as they arise.

SUMMARY OF THE INVENTION

It is an object of the present invention to provide a stacking base system for supporting vertical posts to provide temporary signs or the like that overcomes problems in the prior art.

In a first embodiment the present invention provides a stacking base system for transporting to a work site to support a plurality of posts in a substantially vertical orientation. The system comprises a plurality of hollow base members. Each base member defines a fill port and includes a port plug adapted to be removably inserted in the fill port, and defines a post aperture extending downward through the base member from an upper surface thereof to a lower surface thereof, the post aperture shaped to correspond to a cross-section of the posts. Three legs extend down from outer edges of the lower surface of each base member, the legs substantially equally spaced around the lower surface of the base member, and substantially equally spaced from the post aperture. The post aperture is oriented substantially vertically when bottom ends of the legs are resting on a substantially horizontal surface. The base members are stacked such that a top portion of a lower base member engages a bottom portion of a next adjacent upper base member and such that the plurality of base members forms a base stack.

In a second embodiment the present invention provides a method of supporting a plurality of posts in a substantially vertical orientation. The method comprises providing a plurality of hollow base members, wherein each base member defines a fill port and includes a port plug adapted to be removably inserted in the fill port, and defines a post aperture extending downward through the base member from an upper surface thereof to a lower surface thereof, the post aperture shaped to correspond to a cross-section of the posts, and three legs extending down from outer edges of the lower surface of each base member, the legs substantially equally spaced around the lower surface of the base member, and equally spaced from the post aperture; stacking the base members such that a top portion of a lower base member engages a bottom portion of a next adjacent upper base member and such that the plurality of base members forms a base stack; transporting the base stack to the work site, and removing a selected number of base members from the base stack; inserting a post into each selected base member; placing the selected base members on a substantially horizontal surface such that the posts are oriented substantially vertically.

The present invention thus provides a stacking base system where a large number of base members can be stacked into a compact space and readily transported to a work site and stored ready for use as the need may arise to support posts for signs, cord trees, barriers or the like. The base members can be configured to support post provided by commonly available dimension lumber. A similar stack of cord caps can be provided configured to be placed on top of the posts to provide cord trees.

DESCRIPTION OF THE DRAWINGS

While the invention is claimed in the concluding portions hereof, preferred embodiments are provided in the accompanying detailed description which may be best understood in conjunction with the accompanying diagrams where like parts in each of the several diagrams are labeled with like numbers, and where:

DETAILED DESCRIPTION OF THE ILLUSTRATED EMBODIMENTS

Figure 1:
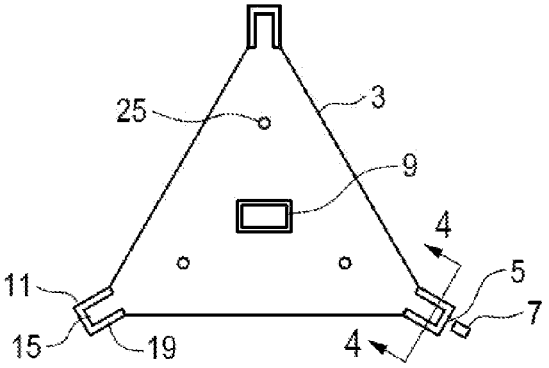
FIG. 1 is a top view of base member for use in the an embodiment of a portable stacking base system of the present invention.
Figure 2:
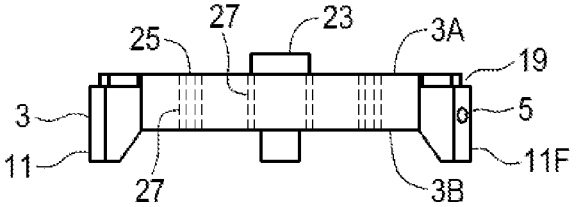
FIG. 2 is a front view of the base member of FIG. 1.
Figure 3:
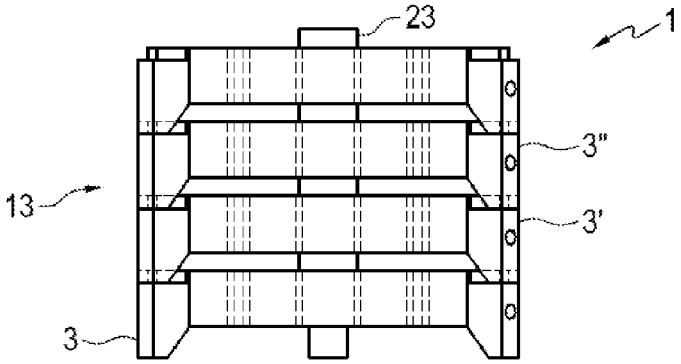
FIG. 3 is a front view the embodiment of a portable stacking base system of the present invention using the base member of FIG. 1.
Figure 5:
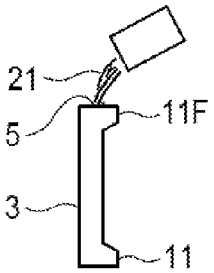
FIG. 5 is a schematic side view of ballast being poured into the fill port of the base member of FIG. 1.

FIG. 3 schematically illustrates an embodiment of a portable stacking base system 1 of the present invention for transporting to a work site to support a plurality of posts in a substantially vertical orientation. The system 1 comprises a plurality of hollow base members 3 as schematically illustrated in FIGS. 1 and 2. Each base member 3 defines a fill port 5 and includes a port plug 7 adapted to be removably inserted in the fill port 5. Ballast material such as water or sand can be poured through the fill port 5 into the hollow interior of the base member 3. The weight of the ballast material will anchor the base member 3 and reduce the occurrence of a post supported therein tipping over from the force of wind, accidental contact, or the like.

A post aperture 9 extends downward through the base member 3 from an upper surface 3A thereof to a lower surface 3B thereof. The post aperture 9 is shaped to correspond to a cross-section of the posts being used. The posts may be of any shape but typically will be provided dimensional lumber that is readily available at the work site. For example it is contemplated that the "2 by 4" that is common at construction work sites and is also readily available at most work sites of any kind, will most commonly be used. A 2 by 4 has a rectangular cross-section measuring about 1.5 inches by 3.5 inches, and the post aperture 9 would then also have a rectangular cross-section measuring about 1.5 inches by 3.5 inches, or slightly larger to allow the post to slide into the post aperture 9 with a snug fit. Each base member 3 also has comprises three legs 11 extending down from outer edges of the lower surface 3B of each base member 3. The legs 11 are equally spaced around the lower surface 3A of the base member 3, and are also substantially equally spaced from the post aperture 9. The post aperture 9 is oriented substantially vertically when bottom ends of the legs 11 are resting on a substantially horizontal surface. Using three legs 11 as opposed to four or more provides stability on uneven surfaces, as all three legs will rest on the surface.

As schematically illustrated in FIG. 3, the base members 3 are stacked such that a top portion of a lower base member 3' engages a bottom portion of a next adjacent upper base member 3" and such that the plurality of base members 3 forms a base stack 13 that is readily transported and stores in a compact area. Thus a large quantity can be transported to a work site and stored in a relatively small area and thus be readily available for use in supporting signs, barriers, cords, or any like purpose that may arise.

Figure 4:
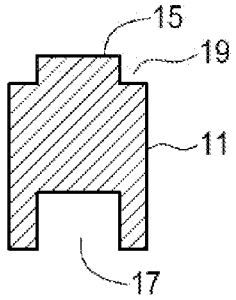
FIG. 4 is a schematic sectional view along lines 4-4 in FIG. 1.

In the illustrated base system 1, the upper surface 3A of each base member 3 defines a stacking lug 15 above each leg, and a bottom surface of each leg 11 defines a bottom recess 17, as best seen in the sectional view of FIG. 4. The stacking lug 15 of the lower base member 3' is slidingly engaged in the bottom recess 17 of the next adjacent upper base member 3". Conveniently since there are three legs 11, each base member 3 is substantially triangular, and each leg 11 extends downward at a corner of the triangular base member 3. The upper surface 3A of each base member 3 defines a top recess 19 along perimeter edges of each corner of the triangle, and the stacking lug 15 is formed inside the top recess 19.

In the illustrated base members 3, the fill port 5 of each base member 3 is defined in an outer side edge of one of the legs 11 at a corner of the base member 3, being the filling leg 11F. Conveniently then the ballast material 21 can be added by tipping the base member 3 upward to rest on side edges of legs 11 opposite the filling leg 11F as schematically illustrated in FIG. 4 such that the fill port 5 is oriented substantially vertically, and the hollow interior of the base member 3 can be completely filled with ballast material 21.

In the illustrated base members 3, a base sleeve 23 extends above the upper surface 3A of each base member 3 such that an inner surface of the base sleeve 23 is aligned with inner walls of the post aperture 9. The base sleeve 23 provides some extra lateral support for the post inserted in the post aperture 9. When the base members 3 are stacked, the base sleeve 23 extends substantially from the upper surface 3A of the lower base member 3 to the lower surface of the next adjacent upper base member, the maximum distance that can be provided and still allow the base members 3 to stack.

Each illustrated base member 3 also defines stake apertures 25 extending downward through the base member 3 from an upper surface 3A thereof to the lower surface 3B thereof. Stakes may driven through the stake apertures 25 into the ground to anchor the base member 3 if desired or if conditions warrant.

The walls 27 of the post aperture 9 and stake apertures 25 extend from the bottom wall of the base member to the top wall thereof inside the hollow interior thereof and act as crush braces to maintain the separation of the top and bottom walls in the base member 3 is subjected to a crushing force, such as being driven over by a vehicle. Further such crush braces may be provided if required.

Figure 6:
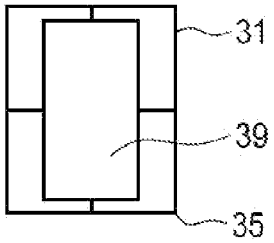
FIG. 6 is a top view of a cord cap for use with the embodiment of FIG. 3 to provide cord trees to support cords, hoses, and the like above the ground.
Figure 7:
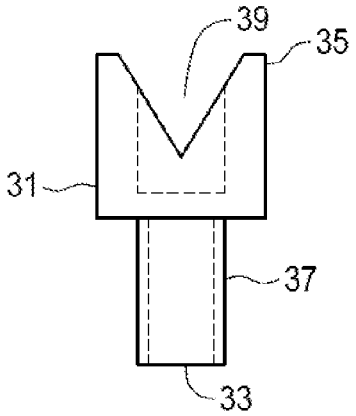
FIG. 7 is a front view of the cord cap of FIG. 6.
Figure 8:
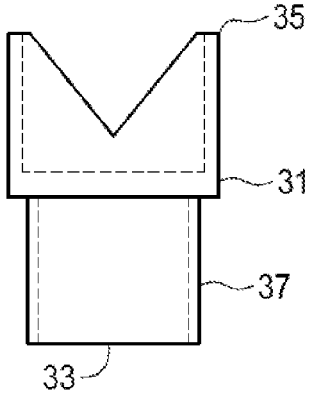
FIG. 8 is a side view of the cord cap of FIG. 6.
Figure 9:
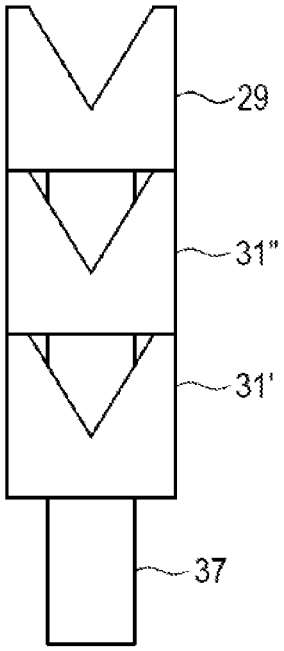
FIG. 9 is a front view of a stack of cord caps of FIGS. 6-8.

FIG. 9 schematically illustrates a stacking cord support assembly 29 for use with the base system 1. The assembly 29 comprises a plurality of cord caps 31 as illustrated in FIGS. 6-8. A lower portion of each cord cap 31 defining a post recess 33 shaped to correspond to a cross-section of the posts, and prongs 35 extending from an upper portion thereof. The cord caps 31 are stacked such that a top portion of a lower cord cap 31' engages a bottom portion of a next adjacent upper cord cap 31".

In the illustrated assembly 29, each cord cap 31 comprises a cap sleeve 37 extending downward and defining the post recess 33. A sleeve recess 39 is defined between the prongs 35, and the sleeve recess 39 of the lower cord cap 31' is substantially filled by the cap sleeve 37 of the next adjacent upper cord cap 31". Thus the cord caps 31 also stack for convenient transportation and storage. When mounted on top of a post a cord, hose, or the like can be laid on the top of the cap 31 between the prongs 35.

The present invention thus further provides a method of supporting a plurality of posts in a substantially vertical orientation. The method comprises providing a plurality of hollow base members 3 as described above and stacking the base members 3 such that a top portion of a lower base member 3' engages a bottom portion of a next adjacent upper base member 3" and such that the plurality of base members 3 forms a base stack 13; transporting the base stack 13 to the work site, and removing a selected number of base members 3 from the base stack 13; inserting a post 41 into each selected base member 3 as schematically illustrated in FIGS. 10 and 11, and placing the selected base members 3 with the legs 11 thereof resting on a substantially horizontal surface 43 such that the posts 41 are oriented substantially vertically.

Where increased stability and resistance to wind or like forces is required, ballast can be added to the base member 3 as described above, or a stake 45 can be inserted through one of the stake aperture 25 extending downward through the base member 3 and driven into the surface 43, such as where the surface is the ground.

Figure 10:
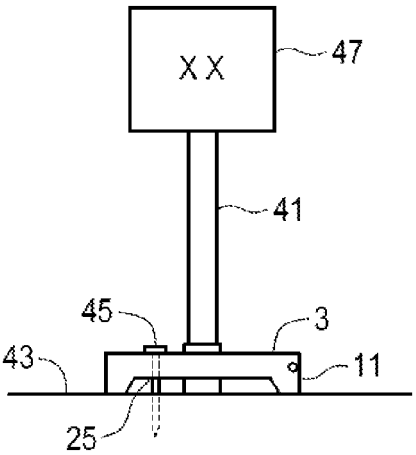
FIG. 10 is a schematic front view of a post supported vertically by a base member of FIG. 1 and supporting a sign.
Figure 11:
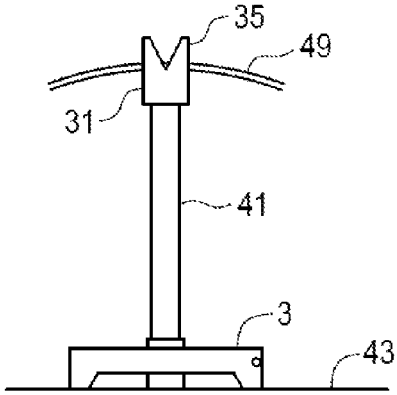
FIG. 11 is a schematic front view of a post supported vertically by a base member of FIG. 1 and supporting a cord cap of FIGS. 6-8.

FIG. 10 schematically illustrates a sign 47 attached to the post 41 such that the sign 47 is supported on an upper portion of the post 41. FIG. 11 schematically illustrates the method of supporting a cord, hose, or the like 49 on a top end of the post 41 by inserting the top end of the post 41 into the post recess 33 defined in a lower portion of a cord cap 31, and positioning the cord, hose, or the like 49 between the prongs 35 extending from the upper portion of the cord cap 31.

The present invention thus provides a stacking base system where a large number of base members can be stacked into a compact space and readily transported to a work site and stored ready for use as the need may arise to support posts for signs, cord trees, barriers or the like. The base members can be stabilized by filling same with ballast material such as water, or where more base weight is required, sand can be used as ballast. Where used outdoors on ground surfaces the base members can be stabilized by driving a stake through stake apertures in the base and into the ground. The posts can be commonly available dimension lumber.

The foregoing is considered as illustrative only of the principles of the invention. Further, since numerous changes and modifications will readily occur to those skilled in the art, it is not desired to limit the invention to the exact construction and operation shown and described, and accordingly, all such suitable changes or modifications in structure or operation which may be resorted to are intended to fall within the scope of the claimed invention.

What is claimed is:

1. A stacking base system for transporting to a work site to support a plurality of posts in a substantially vertical orientation, the system comprising:

a plurality of hollow base members, wherein each base member:

defines a fill port and includes a port plug adapted to be removably inserted in the fill port;

defines a post aperture extending downward through the base member from an upper surface thereof to a lower surface thereof, the post aperture shaped to correspond to a cross-section of the posts;

comprises three legs extending down from outer edges of the lower surface of each base member, the legs substantially equally spaced around the lower surface of the base member, and substantially equally spaced from the post aperture; and wherein the post aperture is oriented substantially vertically when bottom ends of the legs are resting on a substantially horizontal surface;

wherein the base members are stacked such that a top portion of a lower base member engages a bottom portion of a next adjacent upper base member and such that the plurality of base members forms a base stack; and wherein the upper surface of each base member defines a stacking lug above each leg, and wherein a bottom surface of each leg defines a bottom recess, and wherein the stacking lug of the lower base member is slidingly engaged in the bottom recess of the next adjacent upper base member.

2. The system of claim 1 wherein each base member is substantially triangular, and wherein each leg extends downward at a corner of the substantially triangular base member.

3. The system of claim 2 wherein the upper surface of each base member defines a top recess along perimeter edges of each corner, and wherein the stacking lug is formed inside the top recess.

4. The system of claim 2 wherein the fill port of each base member is defined in an outer side edge of one of the corners of the base member.

5. The system of claim 1 wherein each base member defines at least one stake aperture extending downward through the base member from the upper surface thereof to the lower surface thereof.

6. A stacking base system for transporting to a work site to support a plurality of posts in a substantially vertical orientation, the system comprising:

a plurality of hollow base members, wherein each base member:

defines a fill port and includes a port plug adapted to be removably inserted in the fill port;

defines a post aperture extending downward through the base member from an upper surface thereof to a lower surface thereof, the post aperture shaped to correspond to a cross-section of the posts;

comprises three legs extending down from outer edges of the lower surface of each base member, the legs substantially equally spaced around the lower surface of the base member, and substantially equally spaced from the post aperture; and wherein the post aperture is oriented substantially vertically when bottom ends of the legs are resting on a substantially horizontal surface;

wherein the base members are stacked such that a top portion of a lower base member engages a bottom portion of a next adjacent upper base member and such that the plurality of base members forms a base stack;

wherein a base sleeve extends above the upper surface of each base member and wherein an inner surface of the base sleeve is aligned with inner walls of the post aperture; and wherein the base sleeve extends substantially from the upper surface of the lower base member to the lower surface of the next adjacent upper base member.

7. A stacking base system for transporting to a work site to support a plurality of posts in a substantially vertical orientation, the system comprising:

a plurality of hollow base members, wherein each base member:

defines a fill port and includes a port plug adapted to be removably inserted in the fill port;

defines a post aperture extending downward through the base member from an upper surface thereof to a lower surface thereof, the post aperture shaped to correspond to a cross-section of the posts;

comprises three legs extending down from outer edges of the lower surface of each base member, the legs substantially equally spaced around the lower surface of the base member, and substantially equally spaced from the post aperture; and wherein the post aperture is oriented substantially vertically when bottom ends of the legs are resting on a substantially horizontal surface;

wherein the base members are stacked such that a top portion of a lower base member engages a bottom portion of a next adjacent upper base member and such that the plurality of base members forms a base stack; and wherein each base member includes an internal crush brace extending from a bottom wall thereof to a top wall thereof inside a hollow interior thereof.

8. A stacking base system for transporting to a work site to support a plurality of posts in a substantially vertical orientation, the system comprising:

a plurality of hollow base members, wherein each base member:

defines a fill port and includes a port plug adapted to be removably inserted in the fill port;

defines a post aperture extending downward through the base member from an upper surface thereof to a lower surface thereof, the post aperture shaped to correspond to a cross-section of the posts;

comprises three legs extending down from outer edges of the lower surface of each base member, the legs substantially equally spaced around the lower surface of the base member, and substantially equally spaced from the post aperture; and wherein the post aperture is oriented substantially vertically when bottom ends of the legs are resting on a substantially horizontal surface;

wherein the base members are stacked such that a top portion of a lower base member engages a bottom portion of a next adjacent upper base member and such that the plurality of base members forms a base stack; and a stacking cord support assembly comprising a plurality of cord caps, a lower portion of each cord cap defining a post recess shaped to correspond to a cross-section of the posts, and prongs extending from an upper portion thereof; and wherein the cord caps are stacked such that a top portion of a lower cord cap engages a bottom portion of a next adjacent upper cord cap.

9. The system of claim 8 wherein each cord cap comprises a cap sleeve extending downward and defining the post recess, and wherein a sleeve recess is defined between the prongs, and wherein the sleeve recess of the lower cord cap is substantially filled by the cap sleeve of the next adjacent upper cord cap.

* * * * *